US005890550A

United States Patent [19]

Swadi et al.

[11] Patent Number: 5,890,550

[45] Date of Patent: Apr. 6, 1999

[54] EARTH-BORING BIT WITH WEAR-RESISTANT MATERIAL

[75] Inventors: Mohammad Swadi, Corpus Christi; Brian Wiesner; Greg Van Klompenburg, both of The Woodlands, all of Tex.

[73] Assignee: Baker Hughes Incorporation, Houston, Tex.

[21] Appl. No.: 854,200

[22] Filed: May 9, 1997

[51] Int. Cl.[6] ..... E21B 10/50

[52] U.S. Cl. ..... 175/374; 175/408

[58] Field of Search ..... 175/374, 408

[56] References Cited

U.S. PATENT DOCUMENTS

| | | | |
|---|---|---|---|
| 5,074,367 | 12/1991 | Estes | 175/374 |
| 5,201,376 | 4/1993 | Williams | 175/374 |
| 5,421,423 | 6/1995 | Huffstutler | 175/374 |
| 5,553,681 | 9/1996 | Huffstutler et al. | 175/374 |
| 5,709,278 | 1/1998 | Crawford | 175/374 |
| 5,722,497 | 3/1998 | Gum et al. | 175/374 |
| 5,755,301 | 5/1998 | Love et al. | 175/426 |

*Primary Examiner*—Hoang C. Dang
*Attorney, Agent, or Firm*—James E. Bradley

[57] ABSTRACT

An earth-boring bit has a bit body that is threaded at one end for connection into a drill string. At least one cantilevered bearing shaft depends inwardly and downwardly from the bit body. A cutter is mounted for rotation on each bearing shaft and includes a plurality of cutting elements arranged in generally circumferential rows. At least one wear-resistant element is secured to the bit body between the lower end of the bit body and the threaded end, the wear-resistant element being elongate or generally oblong in cross-section.

20 Claims, 2 Drawing Sheets

EARTH-BORING BIT WITH WEAR-RESISTANT MATERIAL

BACKGROUND OF THE INVENTION

1. Field of the Invention

The present invention relates to earth-boring bits of the rolling cutter variety. Specifically, the present invention relates to improving the wear resistance of earth-boring bits.

2. Background Information:

The success of rotary drilling enabled the discovery of deep oil and gas reserves. The rotary rock bit was an important invention that made that success possible. Only soft formations could be commercially penetrated but with the earlier drag bit. The original rolling-cone rock bit, invented by Howard R. Hughes, U.S. Pat. No. 939,759, drilled the hard caprock at the Spindletop field, near Beaumont Tex., with relative ease.

That venerable invention, within the first decade of this century, could drill a scant fraction of the depth and speed of modern rotary rock bits. If the original Hughes bit drilled for hours, the modern bit drills for days. Bits today often drill for miles. Many individual improvements have contributed to the impressive overall improvement in the performance of rock bits.

Earth-boring bits typically are secured to a drill string, which is rotated from the surface. Drilling fluid or mud is pumped down the hollow drill string and out of the bit. The drilling mud cools and lubricates the bit as it rotates and carries cuttings generated by the bit to the surface.

Rolling-cone earth-boring bits generally employ cutting elements on the cutters to induce high contact stresses in the formation being drilled as the cutters roll over the bottom of the borehole during drilling operation. These stresses cause the rock to fail, resulting in disintegration and penetration of the formation material being drilled.

Operating in the harsh down hole environment, the components of earth-boring bits are subjected to many forms of wear. Among the most common forms of wear is abrasive wear caused by contact with abrasive rock formation materials. Moreover, the drilling mud, laden with rock chips or cuttings, is a very effective abrasive slurry.

Many wear-resistant treatments are applied to the various components of the rock bit. Among the most prevalent is the application of a welded-on wear-resistant material or "hardfacing." This material can be applied to many surfaces of the rock bit, including the cutting elements. Commonly assigned U.S. Pat. No. 3,158,214 to Wisler et al., discloses application of hardfacing to the "shirttail" of the bit, a portion of the bit body immediately above the cutters that contacts the sidewall of the borehole and is subject to great abrasive wear. Another solution applied to the shirttail region is a plurality of wear-resistant inserts, similar to those used in the cutters, secured by interference fit in the shirttail. Sometimes, these inserts are designed to cut or actively engage the sidewall of the borehole to act as stabilizers in addition to wear pads.

A need exists, therefore, for earth-boring bits of the rolling-cutter variety having improved means for resisting abrasive wear.

SUMMARY OF THE INVENTION

It is a general object of the present invention to provide an earth-boring bit of the rolling cutter variety having an improved wear-resistant treatment of the shirttail.

This and other objects of the present invention are accomplished by providing an earth-boring bit having a bit body that is threaded at one end for connection into a drill string. At least one cantilevered bearing shaft depends inwardly and downwardly from the bit body. A cutter is mounted for rotation on each bearing shaft and includes a plurality of cutting elements arranged in generally circumferential rows. At least one wear-resistant element secured to the bit body between the lower end of the bit body and the threaded end, the wear-resistant element being elongate or generally oblong in cross-section.

According to the preferred embodiment of the present invention, the bit body comprises at least one bit leg from which the bearing shaft depends. A shoulder is defined on each bit leg below the threaded end of the bit body and a shirttail portion on each bit leg proximal the bearing shaft. The oblong wear-resistant element is secured to the shirttail portion of the bit body between the shirttail and the shoulder.

According to the preferred embodiment of the present invention, the wear-resistant element is formed of hard metal and is secured by interference fit in an aperture in the bit body.

According to the preferred embodiment of the present invention, a plurality of the wear-resistant elements are secured to the bit body between the shoulder and the shirttail, the majority of the wear-resistant elements being secured to the bit body proximal a leading edge of each bit leg.

According to the preferred embodiment of the present invention, the bit has a gage diameter and the wear-resistant elements project from the bit body an amount less than the gage diameter of the bit.

DESCRIPTION OF THE PREFERRED EMBODIMENT

Figure 1:
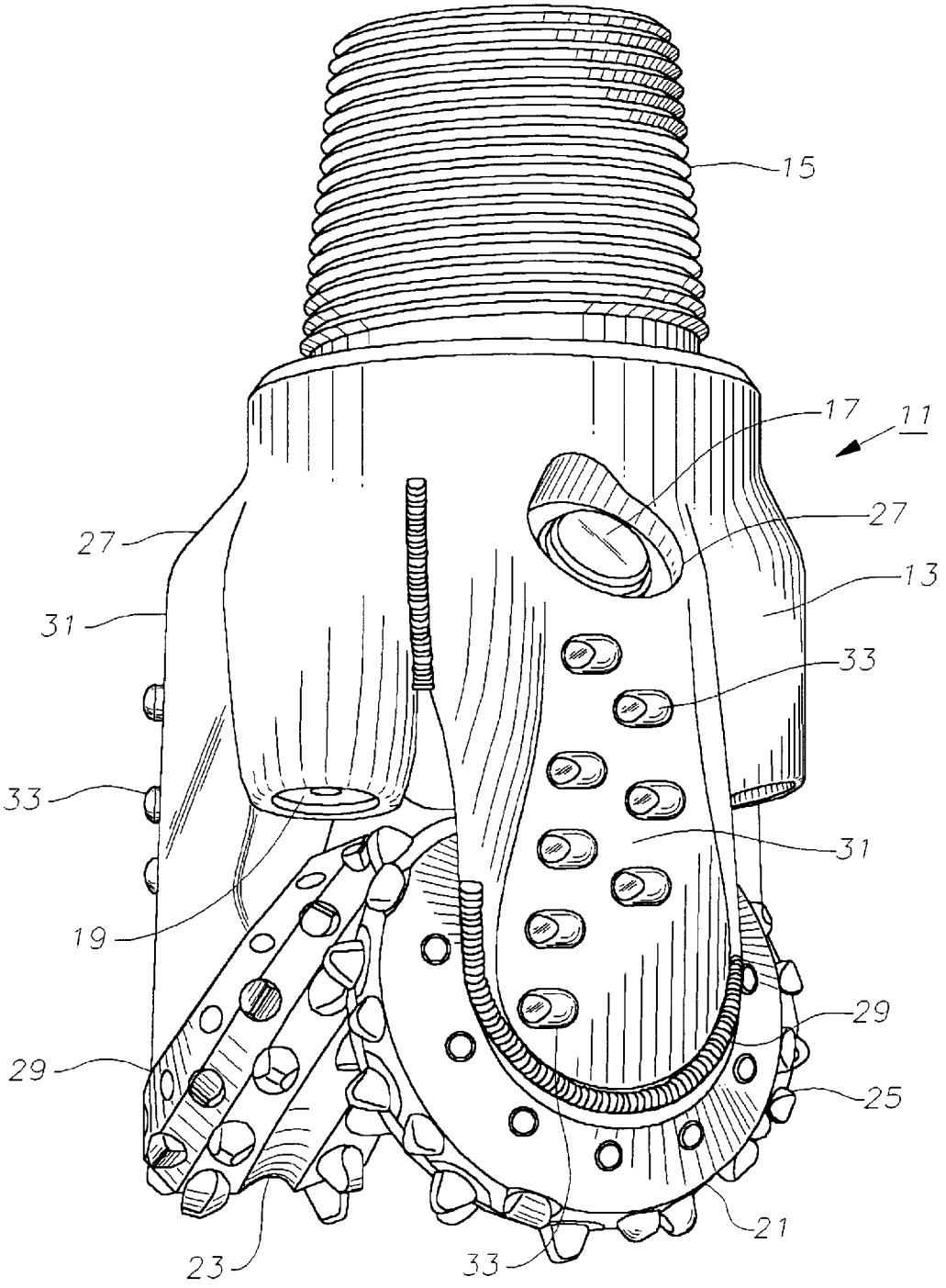
FIG. 1 is a perspective view of an earth-boring bit according to the present invention.

Referring now to the Figures, and particularly to FIG. 1, an earth-boring bit 11 according to the present invention is illustrated. Bit 11 includes a bit body 13, which is threaded at its upper extent 15 for connection into a drill string. Bit body 13 is comprised of three sections or legs, which are individual forgings welded together and machined to form bit body 13. Each leg or section of bit 11 is provided with a lubricant compensator 17, a preferred embodiment of which is disclosed in U.S. Pat. No. 4,276,946, Jul. 7, 1981 to Millsapps. At least one nozzle 19 is provided in bit body 13 to spray drilling fluid from within the drill string to cool and lubricate bit 11 during drilling operation. Three cutters, 21, 23, 25 are rotatably secured to a bearing shaft associated with, and depending inwardly and downwardly from, each leg of bit body 13.

As better seen in FIGS. 2 and 3, a shoulder 27 is defined on each bit leg or section just below the threaded or pin end 15 of body 13. Bit body 13 terminates in a semicircular lower end 29 proximal each cutter and its associated bearing shaft. Region 31 between shoulder 27 and lower end 29 is commonly referred to as the "shirttail." Due to its large surface area and proximity to the sidewall of the borehole in drilling operation, shirttail 31 is exposed to substantial abrasive wear.

To resist this wear, shirttail 31 is provided with a plurality of hard metal, preferably cemented tungsten carbide, inserts or elements 33 secured by interference fit in correspondingly shaped milled slots or apertures in shirttail 33. Alternatively, elements 33 can be brazed into the apertures or otherwise secured to shirttail 31. As described in greater detail below in connection with FIGS. 4 and 5, elements 33 are oblong (or otherwise elongate along one axis) in cross-section.

In FIG. 1, the long axes of elements 33 are oriented transversely or perpendicular to the rotational axis of bit 11. In FIG. 2, the long axes of elements 33 are aligned with the rotational axis of bit 11. In FIG. 3, the long axes of elements 33 are oriented at approximately 45° to the rotational axis of bit 13. In the embodiments of FIGS. 1 and 3, the long axes of elements 33 are at least partially aligned with the direction of rotation of the bit and thus provide extended contact with the sidewall of the borehole. In all embodiments, the majority of elements 33 are disposed proximal the leading edge of shirttail 31 to provide increased wear resistance at this portion of that bears the brunt of the abrasive wear experienced by shirttail 33.

Figure 4:
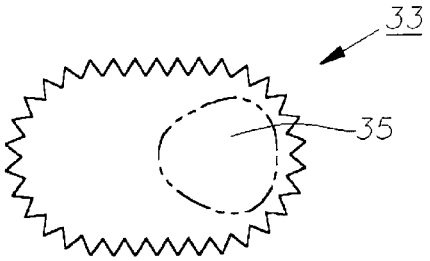
FIG. 4 is an plan view of the wear-resistant insert according to according to the present invention.
Figure 5:
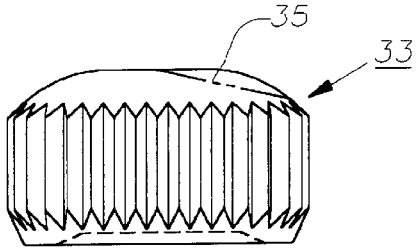
FIG. 5 is an elevation view of the wear-resistant insert according to according to the present invention.

FIGS. 4 and 5 are plan and elevation views, respectively, of oblong element 33 according to the present invention. As can be seen, element 33 is an elongated circle or a rectangle with semicircular ends. This configuration permits element 33 to be secured in a recess or slot that is formed using an end mill. The periphery of element 33 is serrated to facilitate press-fitting into milled slots having a larger range of tolerance.

The uppermost surface of element 33 is enlarged to project above the surface shirttail 31. For the 7–⅞" and 8–¾" bits shown, the uppermost surface of element 33 projects about 0.090" beyond the surface of shirttail 31. As shown in FIGS. 1 and 3, a flat 35 is optionally provided at the leading end (the end oriented toward the leading edge of shirttail 31) and may be formed of or coated with polycrystalline diamond or other super-hard material. Flat 35 tapers downwardly at an angle of approximately 14° to a level flush with the surface of shirttail 31, when element is press-fit therein. All corners and edges of element 33 are rounded to improve strength and prevent cutting engagement with the sidewall of the borehole.

Figure 2:
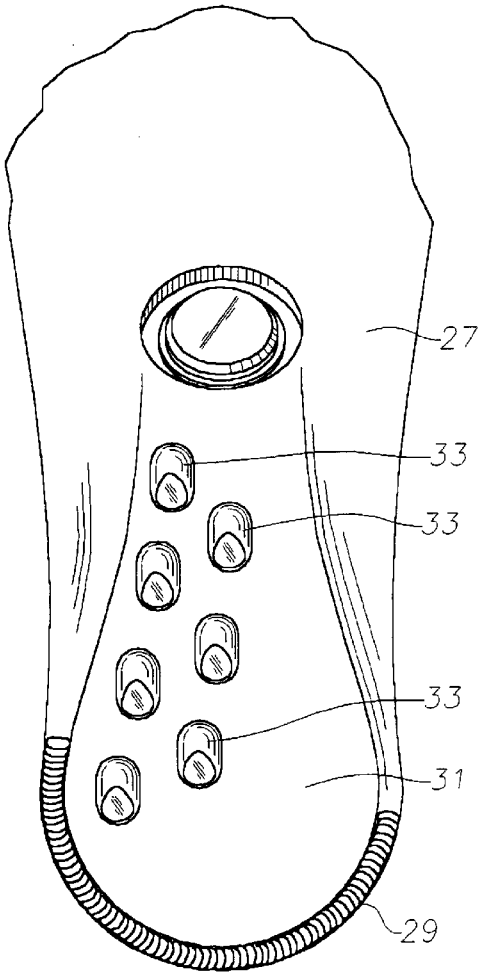
FIG. 2 is a partial view of the shirttail portion of a bit similar to that of FIG. 1.
Figure 3:
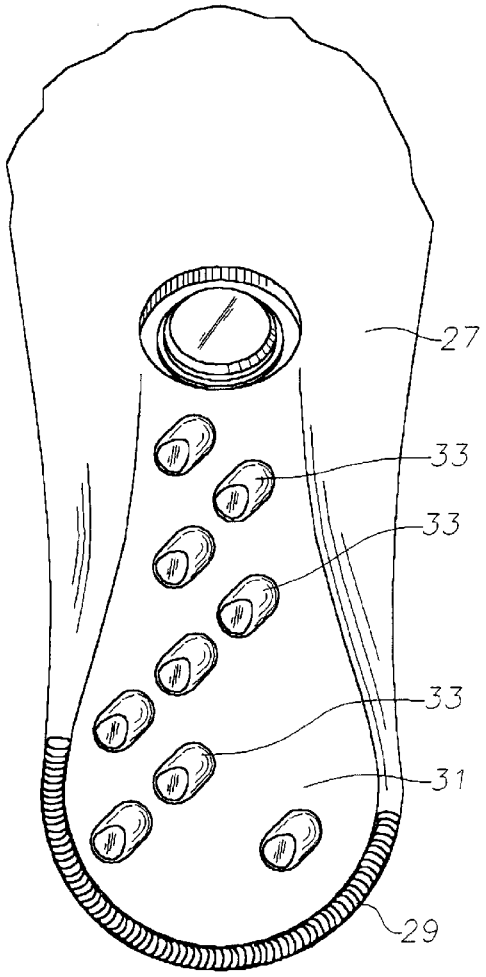
FIG. 3 is a partial view of the shirttail portion of a bit similar to that of FIG. 1.

For the 7–⅞" bits of FIGS. 1 and 2 and the 8–¾" bit of FIG. 3, element 33 is 0.647 inch in length, 0.397 in width (both including serrations), and 0.395 inch in height (all dimensions are nominal). Because elements 33 are intended as wear-resistant only and not to function as cutting elements or as a stabilizer, elements 33 should project a relatively small amount from shirttail. Preferably, the projection of elements is selected to be at least 0.010 inch under the gage diameter of bit 11.

In operation, as bit 11 is rotated in the borehole, cutters 21, 23, 25 roll and slide over the borehole bottom, disintegrating formation material. Oblong wear-resistant elements 33 protect shirttail 31 against abrasive wear. Because elements 33 do not project to gage diameter, engagement between elements 33 and the sidewall of the borehole is minimized as are friction and gouging or cutting of the sidewall. Thus, the overall wear resistance of bit 11 is improved.

The invention has been described with reference to a preferred embodiment thereof. It is thus not limited, but is susceptible to variation and modification without departing from the scope and spirit of the invention.

We claim:

1. An earth-boring bit comprising:

a bit body with threads at one end for attachment to a drill string, the bit body having an axis of rotation;

at least one bearing shaft depending inwardly and downwardly from an end of the bit body generally opposite the threaded end;

a cutter mounted for rotation on each bearing shaft; and at least one wear-resistant element secured to the bit body between the lower end of the bit body and the threaded end, the wear-resistant element being generally oblong in cross-section, the wear-resistant element having a substantially flat portion and a leading edge portion which tapers from the flat Portion toward the bit body.

2. The earth-boring bit according to claim 1 wherein the bit body comprises:

at least one bit leg, the bearing shaft depending from each bit leg;

a shoulder on each bit leg below the threaded end of the bit body;

a shirttail portion on each bit leg proximal the bearing shaft; and the wear-resistant element is secured to the bit body between the shirttail and the shoulder.

3. The earth-boring bit according to claim 2 wherein a plurality of the wear-resistant elements are secured to the bit body between the shoulder and the shirttail, the majority of the wear-resistant elements being secured to the bit body proximal a leading edge of each bit leg.

4. The earth-boring bit according to claim 1 wherein the bit has a gage diameter and the wear-resistant elements project from the bit body an amount less than the gage diameter of the bit.

5. The earth-boring bit according to claim 1, wherein the oblong shape in cross-section of the wear-resistant element has two opposite rounded edges and a long axis which extends through the rounded edges and is oriented to position one of the rounded edges in a leading position relative to the other of the rounded edges considering the direction of rotation of the bit body.

6. The earth-boring bit according to claim 5, wherein the long axis is oriented substantially 45 degrees relative to the bit axis.

7. An earth-boring bit comprising:

a bit body formed of at least one bit section, the bit body being threaded at its upper end for connection to a drill string, the bit body having an axis of rotation;

at least one bearing shaft depending inwardly and downwardly from each bit section of the bit body, each bit section having a shirttail region proximal the bearing shaft;

a cutter mounted for rotation on each bearing shaft; and at least one wear-resistant element secured to the bit body between the shirttail and the threaded end, the wear-resistant element being oblong in cross-section, wherein the wear-resistant element has two opposite rounded edges through which a long axis extends, the wear-resistant element being oriented so that its long axis is at an angle which places one of the rounded edges in a leading position relative to the other of the rounded edges considering the direction of rotation of the bit body.

8. The earth-boring bit according to claim 7 wherein the wear-resistant element is formed of hard metal and is secured by interference fit in an aperture in the bit body.

9. The earth-boring bit according to claim 7 wherein a plurality of the wear-resistant elements are secured to the bit body between the threaded end and the shirttail, the majority of the wear-resistant elements being located on the bit body proximal a leading edge of each shirttail.

10. The earth-boring bit according to claim 7 wherein the bit has a gage diameter and the wear-resistant elements project from the bit body an amount less than the gage diameter of the bit.

11. The earth-boring bit according to claim 7 wherein at least a portion of the wear-resistant element is formed of polycrystalline diamond.

12. The earth-boring bit according to claim 7, wherein the long axis is oriented substantially 45 degrees relative to the bit axis.

13. The earth-boring bit according to claim 7, wherein the wear-resistant element has a leading edge portion which tapers in an outward direction from the bit body relative to the bit axis.

14. An earth-boring bit comprising:

a bit body formed of at least one bit section, the bit body being threaded at its upper end for connection to a drill string and having a bit axis of rotation;

at least one bearing shaft depending inwardly and downwardly from each bit section of the bit body, each bit section having a shirttail region proximal the bearing shaft;

a cutter mounted for rotation on each bearing shaft, portions of the bit body and cutters defining a gage diameter of the bit;

a plurality of oblong wear-resistant elements secured to the bit body between the shirttail and the threaded end, the oblong wear-resistant elements having an outer end projecting from the bit body by an amount less than the gage diameter of the bit; wherein each of the wear-resistant elements has two opposite rounded edges through which a long axis which extends, each of the wear-resistant elements being oriented so that its long axis is at an angle which places one of the rounded edges in a leading position relative to the other of the rounded edges; and each of the wear-resistant elements has a substantially flat surface on its outer end and a tapered surface which is at the rounded edge that is in the leading position, the tapered surface tapering outward from the bit body to the flat surface.

15. The earth-boring bit according to claim 14 wherein the bit body includes a shoulder proximal the threaded end and the wear-resistant element is secured to the bit body below the shoulder.

16. The earth-boring bit according to claim 14 wherein the wear-resistant element is formed of hard metal and is secured by interference fit in an aperture in the bit body.

17. The earth-boring bit according to claim 14 wherein a plurality of the wear-resistant elements are secured to the bit body between the threaded end and the shirttail, the majority of the wear-resistant elements being located on the bit body proximal a leading edge of each shirttail.

18. The earth-boring bit according to claim 14 wherein the bit has a gage diameter and the wear-resistant elements project from the bit body an amount less than the gage diameter of the bit.

19. The earth-boring bit according to claim 14 wherein at least a portion of the wear-resistant element is formed of polycrystalline diamond.

20. The earth-boring bit according to claim 14, wherein the long axis is substantially 45 degrees relative to the bit axis.

* * * * *